US005130557A

United States Patent [19]

Kettl

[11] Patent Number: 5,130,557

[45] Date of Patent: Jul. 14, 1992

[54] PHOTOELECTRIC WEB TENSION DETECTOR FOR SIGNALING WEB BREAK

[75] Inventor: Werner Kettl, Westheim, Fed. Rep. of Germany

[73] Assignee: Grafotec Kotterer GmbH, Diedorf, Fed. Rep. of Germany

[21] Appl. No.: 601,589

[22] Filed: Oct. 23, 1990

[30] Foreign Application Priority Data

Nov. 28, 1989 [DE] Fed. Rep. of Germany ..... 3939226

[51] Int. Cl.[5] ..... G01V 9/04

[52] U.S. Cl. ..... 250/561; 250/223 R

[58] Field of Search ..... 250/223 R, 548, 557, 250/561, 571; 356/429

[56] References Cited

U.S. PATENT DOCUMENTS

| | | | |
|---|---|---|---|
| 3,778,618 | 12/1973 | Laskowski | 250/223 R |
| 4,031,402 | 6/1977 | Dlugos et al. | 250/223 R |
| 4,493,994 | 1/1985 | Hilton | 250/223 R |
| 4,891,528 | 1/1990 | Kuecker et al. | 250/548 |

*Primary Examiner*—David C. Nelms

*Assistant Examiner*—Que T. Le

*Attorney, Agent, or Firm*—Jones, Tullar & Cooper

[57] ABSTRACT

In a web break detecting device for web processing machines, more particularly web fed rotary printing presses, comprising at least one sensing means adapted for cooperation with the web and preferable in the form of a single path photoelectric detector whose beam is normally interrupted by the web and which is adapted to produce a signal if the position of the web should be displaced, in order to achieve a particularly high degree of reliability and very short response times, each sensing means, which is arranged adjacent to a longitudinal edge of the web, is provided with a deflecting means, by means of which a deflecting thrust may be produced permanently acting adjacent to the part of the associated longitudinal edge of the web, and which during normal operation is overridden by the web tension, such thrust causing the longitudinal edge of the web to moved out of the plane of the web during trouble-free operation, when the web tension fails, in relation to the sensing means.

11 Claims, 1 Drawing Sheet

PHOTOELECTRIC WEB TENSION DETECTOR FOR SIGNALING WEB BREAK

BACKGROUND OF THE INVENTION

The invention relates to a web break detecting device for web processing machines, more particularly web fed rotary printing presses, comprising at least one sensing means adapted for cooperation with the web and preferably in the form of a single path, i. e. non-reflective, photoelectric detector whose beam is normally interrupted by the web and which is adapted to produce a signal if the position of the web should be displaced.

An arrangement of this type is described in the German patent publication 2,156,506 B. The detector means in this case consists of single-path photoelectric detectors placed over and under the normal web plane and having light sources and light receivers so arranged adjacent to opposite longitudinal edges of the web that the light beam between the source and the receiver is not interfered with by the web during normal operation and is interrupted by the web if the latter is displaced. The displacement of the web in the case of web tension failing owing to the web breaking is to be caused by the cylinders of the printing unit through which the web passes upstream from the break. Accordingly the photoelectric detectors are in this case arranged at a short distance downstream from these cylinders. While it is true that when the web tension fails the web is carried upwards by the tack of the ink on one of the cylinders, this tendency to move upwards is however opposed by the inertia of the web so that the displacement or deflection of the web takes place comparatively slowly. Therefore in the case of the prior art a relatively long time may elapse before a signal, for instance for stopping the machine, is produced. In the time between the breaking of the web and the stopping of the machine however spoiled produce will result so that raw material costs are increased and additional waste has to be disposed without creating environmental problems. A further point to be considered is that the single path photoelectric detectors of the prior art arrangement have to be mounted in the direct proximity of the cylinders of the printing unit and accordingly are exposed to clouds of atomized ink etc., which will fog over the elements of the detector and thus interfere with the proper function thereof. Moreover, the presence of the photoelectric detectors at only a small distance following the cylinders will impede access thereto and this will make the printing press more difficult to operate.

The German patent publication 3,735,330 A describes a web trapping device which has a suction roll placed a small distance under the web and a bar with jets thereon arranged above the web so that the compressed air issuing from such jets urges the web against the suction roll if the web tension should fail. The vacuum then resulting in the suction roll is detected by a pressure-voltage transducer and converted into electrical signals for control of the machine and the rest of the equipment. The suction roll provided in this system has to be driven. It is thus necessary to provide a branch drive train coming from the main drive of the machine. This often means that it is very difficult, or even not possible at all, to fit a pre-existing plant with such a device, quite apart from the additional power requirement. Furthermore in the prior art arrangement it is mandatory to have a linear array of a large number of jets extending right across the full width of the web. This results in a high air requirement. The prior art thus involves comparatively high running costs and a comparatively complex structure. A particular disadvantage of the prior art arrangement is however to be seen in the fact that the full width of the web has to be deflected and pressed against the suction roll, this means that a powerful thrust is required having regard to the considerable inertia of the web and that there may be a substantial time delay, i.e. a sluggish response.

SUMMARY OF THE PRESENT INVENTION.

Accordingly one object of the present invention is to provide a device of the initially mentioned type which is so improved that the disadvantages of the prior art arrangements are overcome.

In order to achieve these or other objects appearing from the present specification, claims and drawings, in the present invention each sensing means, which is arranged adjacent to a longitudinal edge of the web, is provided with a deflecting means, as for instance blowing or suction nozzles, by means of which a deflecting thrust may be produced permanently acting adjacent to the part of the associated longitudinal edge of the web, and which during normal operation is overridden by the web tension, such thrust causing the longitudinal edge of the web to be moved out of its plane during trouble-free operation, when the web tension fails, in relation to the sensing means.

The arrangement in accordance with the invention offers the advantage that it may be mounted on the machine just where it is required or is most appropriate, that is to say at just that point where monitoring of the web is particularly important and this will mean a point where experience has shown that there is a particularly high chance of web breakage, as for instance adjacent to the drier arranged following the last printing unit and at positions where access to other parts of the plant are not impeded. An important factor making it a free choice possible of the position of the photoelectric detector is in this respect not only the association of the deflecting means with each detector means, but also its placement in such a manner that only one edge of the web has to be monitored and deflected. In fact the effects on the web if the tension should fail are greatest adjacent to the edge and are most quickly detected, this leading to a high degree of reliability and a particularly short response time. Owing to the fact that only the web edge is monitored there is not only a very compact design but also an extremely simple and economic one. There is the advantage that the arrangement in accordance with the invention does not require any drive. The freedom of placement and the simple and compact and more particularly drive-less design thus makes it a simple matter to fit the web break detecting device in accordance with the invention to pre-existing plant.

Further features and advantages of the invention are defined in the claims.

As one particular advantage of the invention the deflecting means may comprise, as noted above, an air flow orifice, more particularly a jet orifice, which is connected with a means producing a pressure differential, preferably a source of compressed air and is adapted to produce an air flow moving in the direction of deflection and is preferably arranged opposite to the trailing web surface, that is to say the surface which is to the rear in the direction of deflection. The features lead to the advantage of contact-less deflecting means.

The use of blowing jet nozzles may be particularly advantageous because in this case a required compressed air source is generally already present in the form of a compressed air supply system. Furthermore the air flow able to be produced by a nozzle may be precisely directed onto the desired area of longitudinal edge of the web and the force produced thereby may be simply adjusted. On the other hand the use of a suction nozzle offers the advantage of a certain vacuum cleaning effect.

In accordance with a further possible development of the invention the detecting means is aligned so that its axis is inclined in relation to the direction of the thrust of the deflecting means and extends in a plane which runs transversely to the longitudinal direction of the web. Owing to the inclination provided in the present case of the detecting means to the direction of deflection it is possible to ensure that the monitored longitudinal edge of the web is able to be brought into and, respectively, out of engagement with the detecting means if deflection takes place.

In this respect it is convenient if the deflecting means is arranged so that its direction of thrust is approximately perpendicular to the plane of the web and the detecting means is arranged so that its axis intersects the web plane at an acute angle. Owing to the direction of the thrust being perpendicular to the plane of the web there is then a powerful and reliable deflection of the web.

A further possible feature of the invention is such that the axis of the detecting means past which one longitudinal edge of the web moves, extends outwards in terms of the deflection direction of the web. This makes it possible to ensure that the deflected longitudinal edge of the web is cleared from engagement with the detecting means. The latter may then simply be designed in the form of a single path photoelectric detector adapted to sense the longitudinal edge of the web whose light beam between its transmitter and receiver placed above and under the web is interrupted during normal operation. During such normal operation the light beam between the transmitter and the receiver is interrupted. If the web should break the light beam between the transmitter and the receiver is no longer interrupted so that the desired signal is produced. Since in the invention no continuous signal is produced during normal running there is the advantage of simple circuitry.

A further possible and particularly preferred feature of the invention is such that the direction of the thrust of the deflecting means is vertically downwards and the element of the detecting means under the plane of the web is outwardly offset in relation to the associated upper element and is preferably arranged outside the longitudinal edge of the web. This means that particularly short response times may be expected, since the deflecting force taking effect is reinforced by the force of gravity and longitudinal edge of the web is out of reach of the detecting means even if there is only a comparatively small deflection.

Further features and advantages of the invention will be gathered from the ensuing detailed description of one embodiment thereof referring to the drawings.

DETAILED DESCRIPTION OF WORKING EMBODIMENT OF THE INVENTION.

Figure 1:
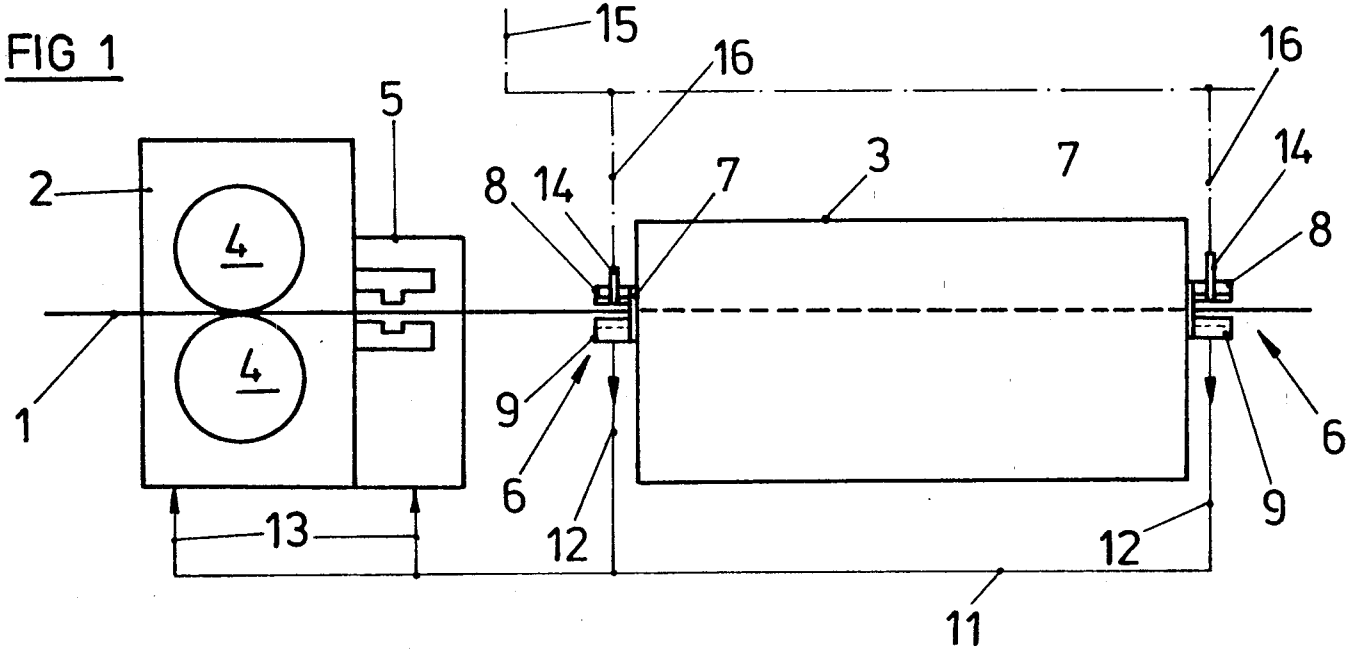
FIG. 1 is a diagrammatic side view of a web feed rotary printing press.

The paper web 1 shown in FIG. 1 leaves the last printing unit 2 of a printing press as indicated and is then dried in a drier 3. The path of the paper in the drier 3 has turned out from experience to be one of the parts in which the paper web 1 is particularly likely to break. In order in the case of a break to prevent the paper web winding up onto one of the cylinders 4 of the printing unit 2 when a break occurs, there is a paper web trapping device 5 arranged upstream from the danger zone, that is to say in the present case the drier, such paper web trapping device being activated if the paper web should break. In the illustrated working embodiment the web trapping device 5 is simply in the form of a paper web clipping device. In lieu of such a clipping device it would obviously be possible to have other designs, as for example means winding up the paper web or, respectively, paper web breaking off devices and the like. Simultaneously with the activation of the paper web trapping device 5 the drive of the printing press 2 is discontinued.

In order to produce the signal necessary for activation of the paper web trapping device 5 and to stop the printing press 2, there are one or more paper web break detecting devices 6 arranged in the danger zone, which are in the position of monitoring the setting of the paper web and of providing a signal if the paper web is displaced. In the illustrated working embodiment in which the drier 3 constitutes the hazard zone, there are suitable paper web break detecting devices 6 arranged at the intake and outlet of the drier 3. These detecting devices may be respectively mounted on a holder 7 attached to the housing of the drier 3. It is obviously possible for the detecting devices with their paper web trapping devices, which are actuated by them, to be arranged in other danger areas, as for instance in the part between two consecutive printing units.

The web break detecting devices 6 each comprise a single path photoelectric detector consisting of a transmitter 8 and a receiver 9, which as the elements of the detecting device are arranged opposite each other with respect to the plane to which the paper web keeps during normal operation, that is to say above and below the web plane. In the illustrated working embodiment the transmitter 8 is respectively arranged above the web plane and the receiver 9 is placed under the web plane.

Figure 2:
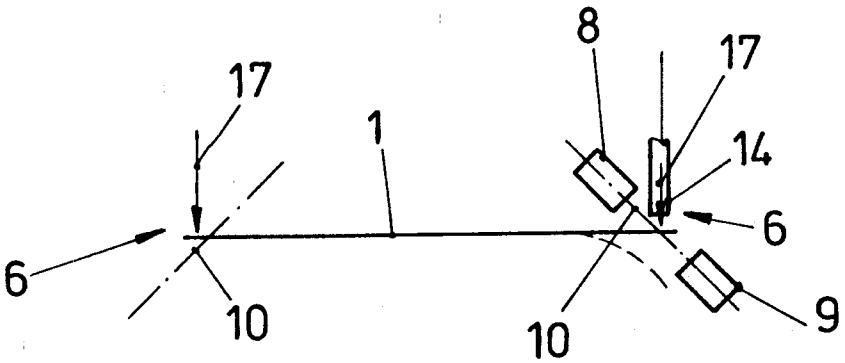
FIG. 2 is a diagrammatic view, looking in the longitudinal direction of the paper web, of the web break detecting device in accordance with the invention.

The optic axis 10, denoted in FIG. 2 by a broken line, of the photoelectric detectors corresponds to the path of the beam between the transmitter and the associated receiver. During normal operation, that is to say when the paper web 1 is taut, the optic axis 10 of the single path photoelectric detectors of the paper web break detecting devices 6 arranged in the vicinity of the longitudinal edge of the paper web is cut by the respectively adjacent longitudinal edge of the paper web 1, as is clearly shown in FIG. 2. In this case the light beam is interrupted between the transmitter 8 and the receiver 9 by the longitudinal edge of the paper web 1 coming in between the transmitter 8 and the receiver 9. The single path photoelectric detector comprising the transmitter 8 and the receiver 9 accordingly does not provide any signal. If the paper web 1 is broken, that is to say if the paper web tension fails, the longitudinal edge of the paper web 1 in the photoelectric detector, as is illustrated in FIG. 2 by a broken line, may be so far deflected from the normal web plane that there is no longer any intersection between the optic axis 10 and the paper web 1 and there is therefore also no interruption of the ray path between the transmitter 8 and the receiver 9. In such a case the light beam emitted by the transmitter 8 impinges on the receiver 9 so that the latter produces a signal which may be used to activate the paper web trapping device 5 and for stopping the printing press 2, as is indicated in FIG. 1 by the line 11 carrying the signal with inputs 12 from the web break detecting devices 6 and with outputs 13 leading to the paper web trapping device 5 and the printing press 2.

In order to ensure reliable deflection of the longitudinal edge of the paper web entering the zone between the transmitter 8 and the receiver 9 of a single path photoelectrical detector functioning as a sensing means, each sensing means, which in the present case is in the form of a single path photoelectric detector, is provided with a deflecting device, which in the illustrated working embodiment is simply in the form of a blowing jet 14 arranged in the vicinity of the associated sensing device on the top side of the longitudinal edge of the paper web 1, such nozzle being able to be supplied with compressed air. For this purpose the blowing nozzles are connected with a source of compressed air, in the present case this works for the compressed air system 15, as is indicated in FIG. 1 by branch pipes 16. The blowing nozzles 14 are in the illustrated working embodiment arranged so as to be generally perpendicular to the normal feed plane of the paper web 1 in the part, which is sensed by the photoelectric detector, of the longitudinal edge of the paper web 1, which in the present case is directed towards the longitudinal edge part placed clear of the point of intersection between the optic axis 10 and the paper web 1.

The air flow able to be produced by means of a flowing nozzle 14 or, respectively, the thrust produced thereby and acting on the longitudinal edge of the paper web as indicated by the arrow is so set that the longitudinal edge of the paper web 1 is not deflected if the paper web is under tension, that is to say during normal operation. Accordingly during such normal running the thrust indicated by the arrow 17 is overcome by the web tension. It is only when there is breakage of the paper web and the web tension fails that the blowing nozzle 14 causes the deflection indicated in FIG. 2 by a broken line, of the associated longitudinal edge of the paper web 1 so that the above-described switching operation takes place.

The blowing nozzle 14 directed perpendicularly onto the longitudinal edge of the paper web 1 causes a downward deflection of the lateral edge part of the paper web 1. In order to be sure that the paper web 1 and its deflected lateral edge is then moved out of the position between the transmitter 8 and the receiver 9, that is to say clear of the sensing device, the optic axis 10 of the single path photoelectric detector, which here forms the sensing device, is arranged to be parallel to a plane running transversely to the longitudinal direction of the paper web 1 and it is so inclined in relation to the normal plane of the paper web that it extends in the deflection direction, that is to say here in a downward direction and to the outside. The receiver 9 placed under the normal plane of the paper web 1 of the photoelectric detector is accordingly outwardly offset in relation to the transmitter 8 which is arranged above the normal plane of motion of the paper web 1. In the illustrated working embodiment the optic axis 10 is set at an acute angle of 45° to the normal paper web plane, this making possible a considerable offset between the transmitter 8 and the receiver 9. Owing to the inclination of the optic axis 10 the element placed under the paper web plane of the sensing device, in the present case the receiver 9, may be placed fully clear of the longitudinal edge of the paper web to be monitored, this making possible unobstructed deflection of the lateral edge part of the paper web 1, as is to be readily seen from FIG. 2. The upper element, that is to say the rear element in the direction of deflection, and in the present case the transmitter, may readily be placed within the area of the paper web 1.

In lieu of the blowing nozzle it would also be possible to provide a suction nozzle to produce the deflection thrust, by which the respective edge part of the paper web 1 is shifted as soon as there is no tension to keep it in place. In the illustrated working embodiment with deflection in a downward direction such a suction nozzle would have to be arranged under the normal paper plane. It would also be possible to so arrange the photoelectric detector etc. functioning as the sensing device that during normal operation a continuous signal is produced and it would be interrupted in the case of the paper web being deflected. In the illustrated working embodiment it would for this purpose only be necessary to turn the optic axis 10 though 90° and to move it so far outwards that during normal operation there would be no intersection between the axis 10 and the paper web 1.

FIG. 2 will be seen to indicate the presence of two mutually opposite paper web break detecting devices 6 arranged symmetrically with respect to a web with a longitudinal plane. As a result it is possible to achieve a high degree of reliability and very short response times, since a break in a paper web will always begin at a longitudinal edge thereof and come to an end at the other longitudinal edge. If both the longitudinal edges are to be monitored, it is possible to ensure that the desired switching operation is started at the very beginning of the paper tearing.

The photoelectric detector of the working example for forming the sensing device constitutes a particularly simple, economic and sturdy unit. It would obviously be possible however to use electrical switches, preferably in the form of so-called capacitive switches in order to sense the longitudinal edges of the paper web. This represents another way of sensing the paper web without making physical contact therewith.

I claim:

1. A web break detecting device for a web under tension of a web processing machine, comprising at least one photoelectric detector arranged adjacent to a longitudinal edge of the web and adapted for cooperation with the web such that a beam generated by the photoelectric device is normally interrupted by the web, and adapted to produce a signal if the position of the web should be displaced; and deflecting means, producing a deflecting thrust permanetly acting adjacent to the part of the associated longitudinal edge of the web, and which during normal operation is overridden by the web tension, such thrust urging the longitudinal edge of the web out of the plane of the web during trouble-free operation, when the web tension fails, in relation to the photoelectric detector.

2. The web break detecting device as claimed in claim 1, wherein said photoelectric detector is a single path detector having a transmitter and a receiver between which light is arranged to be shone along a single path.

3. The web break detecting device as claimed in claim 1, wherein the deflecting device comprises at least one air nozzle connected with a source of air at a differential pressure and adapted for a flow direction in the same direction as the direction of deflection of the paper web.

4. The web break detecting device as claimed in claim 3, wherein the deflecting means has at least one blowing nozzle connected with the source of air under pressure, said nozzle being arranged opposite to the face of the web which is to the rear in terms of the direction of deflection.

5. The web break detecting device as claimed in claim 1, wherein the photoelectric device is aligned so that its axis is inclined in relation to the direction of thrust of the deflecting means and within a plane which runs transversely in relation to the longitudinal direction of the web.

6. The web break detecting device as claimed in claim 5, wherein the photoelectric detector is set at an acute angle of preferably 45° to the plane of the web.

7. The web break detecting device as claimed in claim 1, wherein the deflecting device is arranged so that its thrust direction is essentially perpendicular to the plane of the web.

8. The web break detecting device as claimed in claim 5, wherein the axis of the photoelectric detector past which a longitudinal edge of the web moves extends outwards in the direction of deflection of the web.

9. The web break detecting device as claimed in claim 8, wherein said photoelectric detector is a two-part single beam detector with two elements arranged on an axis intersecting the plane of the web so that such elements are opposite to each other in relation to the web plane, one of the elements located in the upstream direction of deflection being outwardly offset in relation to the other element located in the downstream direction of deflection.

10. The web break detecting device as claimed in claim 9, wherein the element, which is located in the upstream direction of deflection is arranged outside of the associated longitudinal edge of the web and the element which is located in the downstream direction of deflection is arranged inside the longitudinal edge of the web.

11. The web break detecting device as claimed in claim 7, wherein the photoelectric device has an element under the plane of the web and one element over the plane of the web, and wherein the direction of the thrust generated by the deflecting device is vertically downwards and the element of the photoelectric detector under the plane of the web is outwardly offset in relation to the upper element of the photoelectric detector and is preferably arranged outside the longitudinal edge of the web.

* * * * *